US007555880B2

(12) United States Patent
Porter et al.

(10) Patent No.: US 7,555,880 B2
(45) **Date of Patent: *Jul. 7, 2009**

(54) AUTOMATED PROCESS FOR COUNTING AND FILLING CONTAINERS WITH MEAT AND POULTRY PRODUCTS

(75) Inventors: Brian Porter, Lula, GA (US); Robert Scott, Fort Smith, AR (US)

(73) Assignee: Gainco, Inc., Gainesville, GA (US)

( * ) Notice: Subject to any disclaimer, the term of this patent is extended or adjusted under 35 U.S.C. 154(b) by 86 days.

This patent is subject to a terminal disclaimer.

(21) Appl. No.: 11/845,458

(22) Filed: Aug. 27, 2007

(65) Prior Publication Data

US 2008/0010952 A1 Jan. 17, 2008

Related U.S. Application Data

(63) Continuation-in-part of application No. 10/943,416, filed on Sep. 17, 2004, now Pat. No. 7,261,130.

(60) Provisional application No. 60/505,664, filed on Sep. 24, 2003.

(51) Int. Cl.
*B65B 1/30* (2006.01)
*B65B 35/30* (2006.01)

(52) U.S. Cl. ..... 53/443; 53/495; 53/501; 53/502

(58) Field of Classification Search ..... 53/52, 53/493, 495, 498, 500, 501, 147, 502, 443; 141/10, 67, 83, 94, 129, 313
See application file for complete search history.

(56) References Cited

U.S. PATENT DOCUMENTS 4,094,413 A 6/1978 Altenpohl et al.
4,286,679 A 9/1981 Schneider
4,621,664 A 11/1986 Pryor et al.
5,029,431 A 7/1991 Weening et al.
5,184,733 A 2/1993 Anarson et al.
5,229,840 A 7/1993 Anarson et al.
5,582,283 A 12/1996 Anarson
5,671,787 A 9/1997 Wehrmann
5,758,477 A 6/1998 Wilson et al.
5,871,078 A 2/1999 Anarson et al.
5,971,037 A 10/1999 Ansaloni
6,066,037 A 5/2000 Anarson
6,138,817 A 10/2000 Hjalmarsson et al.
6,164,174 A 12/2000 Sigurdsson et al.

(Continued)

FOREIGN PATENT DOCUMENTS

WO WO02/054876 11/2002

*Primary Examiner*—Rinaldi I. Rada
*Assistant Examiner*—John Paradiso
(74) *Attorney, Agent, or Firm*—Tarolli, Sundheim, Covell & Tummino LLP

(57) ABSTRACT

An apparatus for delivering desired counts of products to containers. The apparatus includes a conveyor for moving discrete product portions along a path of travel. A force detecting device located along the path of travel measures force applied to the force detecting device. A counter adds one to a product count each time a force in a product identifying range is measured. A directing structure directs the product portions into a first container until the product count reaches a desired container count and directs the product portions into a second container after the product count reaches the desired container count.

28 Claims, 12 Drawing Sheets

U.S. PATENT DOCUMENTS 6,321,135 B1 11/2001 Asgeirsson
6,433,288 B1 8/2002 Olafsson
6,546,304 B2 4/2003 Thorvaldsson et al.
6,684,914 B2 2/2004 Gershman et al.
2003/0036344 A1 2/2003 Sigurdsson et al.

AUTOMATED PROCESS FOR COUNTING AND FILLING CONTAINERS WITH MEAT AND POULTRY PRODUCTS

CROSS-REFERENCE TO RELATED APPLICATION

The present application is a continuation-in-part of U.S. application Ser. No. 10/943,416, filed on Sep. 17, 2004, assigned to the assignee of the present application, which, in turn, claimed priority under 35 USC 119(e) from provisional application Ser. No. 60/505,664, filed Sep. 24, 2003. The aforesaid '416 application and the '664 provisional application are both incorporated herein in their respective entireties by reference. The aforesaid '416 application will issue as U.S. Pat. No. 7,261,130 on Aug. 28, 2007.

FIELD OF THE INVENTION

The present invention concerns food product portion counting, more particularly, the present invention concerns food product portion counting using a force detecting device.

BACKGROUND ART

Meat, poultry and fish processors have difficulty accurately filling boxes, bags or other containers with fixed quantities or counts of fresh, frozen or cooked products. Under filling a container can cause customer dissatisfaction and overfilling a container results in costly "give away" of expensive products. At present, most operations are manual in nature and involve utilizing operators to count the products and then fill the respective containers. Manual counting and filling has several disadvantages. For example, miscounts due to operator error. Manual counting and filling is labor intensive, resulting in a high cost per container and less than desired container filling rates.

Attempts have been made to automate the counting and filling process by utilizing electrical photoeye counting systems to count the products as they pass by on a moving conveyor belt. The process is initiated with operators filling the pockets of a moving, pocketed conveyor belt with a single product per pocket. Photoeyes, used in conjunction with a control system and located near the exit of the conveyor belt, are used to directly count the product in each pocket as they pass by. Once the desired count is achieved, the controller will cause the product coming off the exit of the conveyor to divert to a new package or container.

Several problems are associated with photoeye counting systems. The photoeye can be blocked by pieces of skin, loose breading, fat, water droplets or other by-products from meat. It is difficult to set up the photoeyes and an associated control system to consistently detect and count meat products that vary in size, shape, height and position within the pocket. Optimum container filling rates are not achieved, due to time allowed for the actuation of the product diverter and the container indexing device.

SUMMARY OF THE INVENTION

The present invention concerns a method and apparatus for delivering desired counts of product portions into containers. In the method, discrete product portions are moved into engagement with a force detecting device. Force applied to the force detecting device is repeatedly measured. One is added to the product count each time a force in a product identifying range is measured. The product portions are then directed into a first container until the product count reaches a desired container count. The product portions are directed into a second container after the product count reaches the desired container count.

One apparatus for delivering desired counts of product portions to containers includes a conveyor, the force detecting device, a counter, and a directing structure. The conveyor moves discrete product portions along a path of travel. The force detecting device is located along the path of travel and measures force applied to the force detecting device. The counter that adds one to the product count each time a force in a product identifying range is measured. The directing structure directs the product portions into a first container until the product count reaches the desired container count and directs the product portions into a second container after the product count reaches the desired container count.

In one embodiment, the speed of the conveyor is slowed during a transition period when product portions begin to be directed to the second container. The desired count per container, the minimum and maximum forces that define the product identifying range, and the desired number of containers to be filled for a particular product order may be selected by an operator using a user input device.

In one embodiment, miscounts are detected. A miscount occurs when an operator places two or more product portions in a single conveyor space. A miscount may be identified when a force greater than a maximum force of the product identified range is measured. A miscount may be identified by measuring times between engagements of product portions with the force detection device. A miscount is detected when a measured time is less than a predefined minimum time between engagements.

Detection of a miscount may be handled in a variety of ways. In one embodiment, the count is automatically corrected when a miscount occurs. For example, two (one for the original product count and one for the additional product portion) may be added to the product count when a miscount is detected. In another embodiment, the container that includes a miscount is identified or flagged. The operator can then check the container count and add or remove product portions accordingly. In one embodiment, the flow of product portions to a flagged miscount container is stopped, the count is reset, and product portions are sent to another container.

These and other objects and advantages of the system constructed in accordance with exemplary embodiments of the invention are more completely described in conjunction with the accompanying drawings.

DETAILED DESCRIPTION

Figure 3:
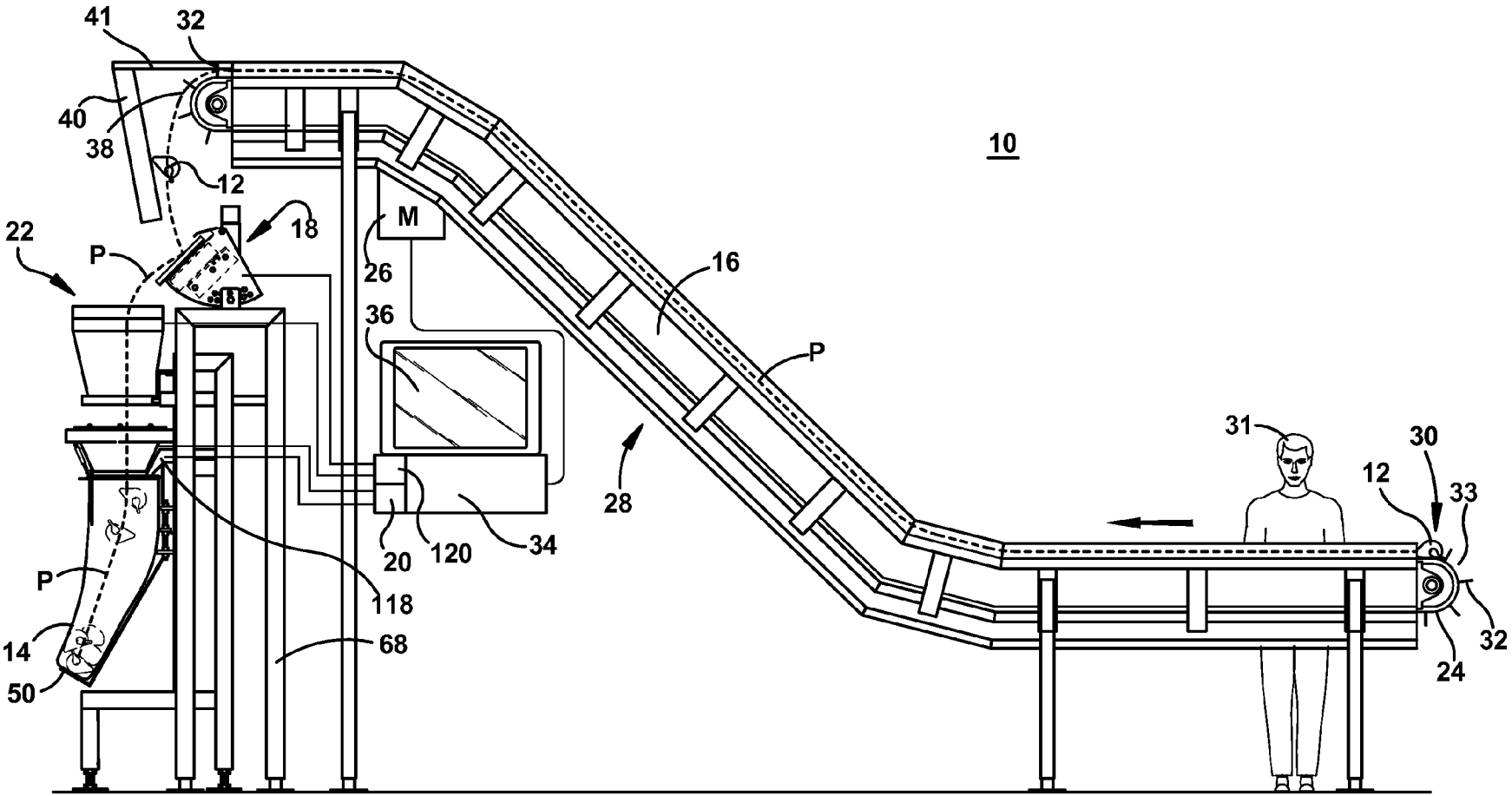
FIG. 3 is a side elevation view of an apparatus for counting and filling containers with product portions.

The present disclosure is directed to a method and apparatus 10 for delivering desired counts of product portions 12 to containers 14. Examples of product portions include poultry, beef, pork, and fish portions. The apparatus 10 includes a conveyor 16, a force detecting device 18, a counter 20, and a directing structure 22. Referring to FIG. 3, the conveyor 16 moves discrete product portions along a path of travel P. The force detecting device 18 is located along the path of travel of the product portions 12. The force detecting device 18 measures force applied to the force detecting device by product portions 12 that impact the force detecting device. The counter 20 adds one to a product count each time a force in a product identifying range is measured by the force detecting device 18. The directing structure 22 directs the product portions 12 into a first container 14 until the product count reaches a desired container count. Once the desired count in the first container is achieved, the directing structure 22 directs the product portions into a second container and the counter 20 counts the product portions delivered into the second container.

Figure 1:
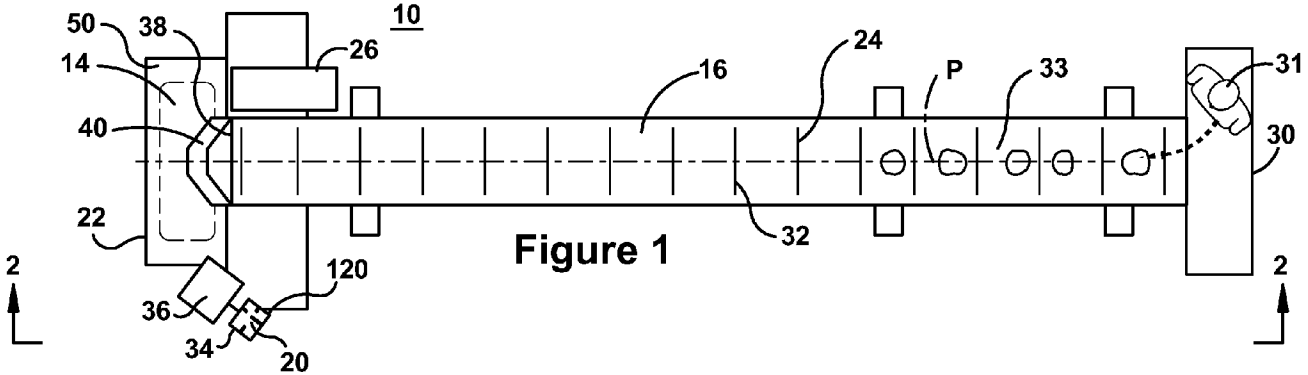
FIG. 1 is a plan view of an apparatus for counting and filling containers with product portions.
Figure 2:
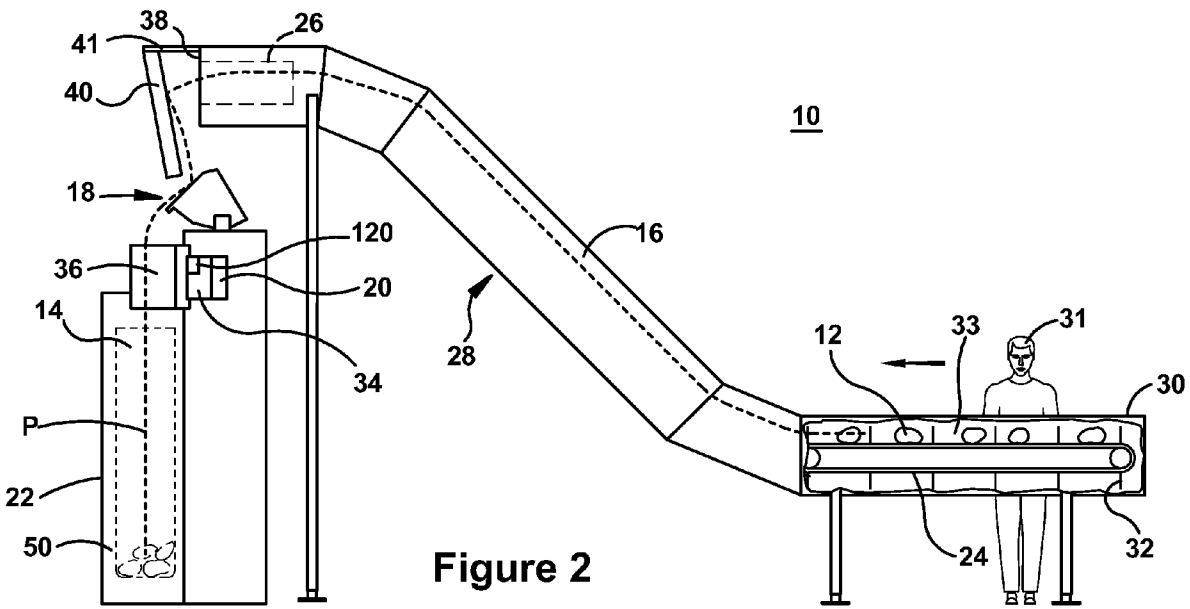
FIG. 2 is a view taken along the plane indicated by lines 2-2 in FIG. 1.

Referring to FIGS. 1-3, the product portions 12 travel along the path of travel P from a loading station 30 to a packaging station 50. The path of travel P starts at the loading station 30 where operator(s) 31 place product portions 12 on the conveyor. The product portions are moved along the path of travel P by the conveyor 16 to a conveyor end 38. The product portions 12 fall off the conveyor end 38 and are directed by a guide 40 into the force detecting device 18. The portions deflect off of the force detecting device 18 and fall into the directing structure 22. The product portions 12 fall from the directing structure 22 into the packaging station 50.

Referring to FIGS. 1-3, the illustrated conveyor 16 includes a flighted belt 24 that is driven by a motor 26. The flighted belt allows the product portions to be moved up a hill 28 as illustrated in FIGS. 2 and 3. In one embodiment, operator(s) at the loading station 30 are instructed to place one product portion 12 in each pocket 33 of the flighted belt 24. When the apparatus 10 is included in a line for packaging a single type or general size of product portion, the spacing between vanes 32 of the flighted belt is set to inhibit operator (s) from placing more than one product portion in a pocket 33.

In the exemplary embodiment, a controller 34 is in communication with the motor 26. The controller 34 controls the speed of the conveyor 16 as well as other functions of the apparatus 10. In the illustrated embodiment, the counter 20 is part of the controller 34. The controller 34 may slow a speed of the conveyor 16 during a transition period when product portions begin to be directed to the second container.

In the exemplary embodiment, a user input device 36, such as a touch screen, is in communication with the controller 34. The user input device allows an operator to input the desired count (number of product portions) per container 14. The user input device 36 allows a user to input minimum and maximum forces that define the product identifying range. The user input device allows a user to input a desired number of containers to be filled for a particular product.

Referring to FIGS. 2 and 3, in the exemplary embodiment, a user input device 36, such as a touch screen, is in communication with the controller 34. The user input device allows an operator to input the desired count (number of product portions) per container 14. The user input device 36 allows a user to input minimum and maximum forces that define the product identifying range. The user input device allows a user to input a desired number of containers to be filled for a particular product.

Referring to FIGS. 2 and 3, the guide 40 directs the product portions into engagement with the force detecting device 18. The illustrated guide 40 is an elongated member that is bent to prevent product portions from moving laterally past the edges of the guide. The guide 40 is supported above the force detecting device at an angle by a support member 41 that extends from the conveyor 16. When product portions 12 fall from the conveyor end 38, the guide acts as a chute or slide that directs the product portions into contact with the force detecting device 18.

Figure 4:
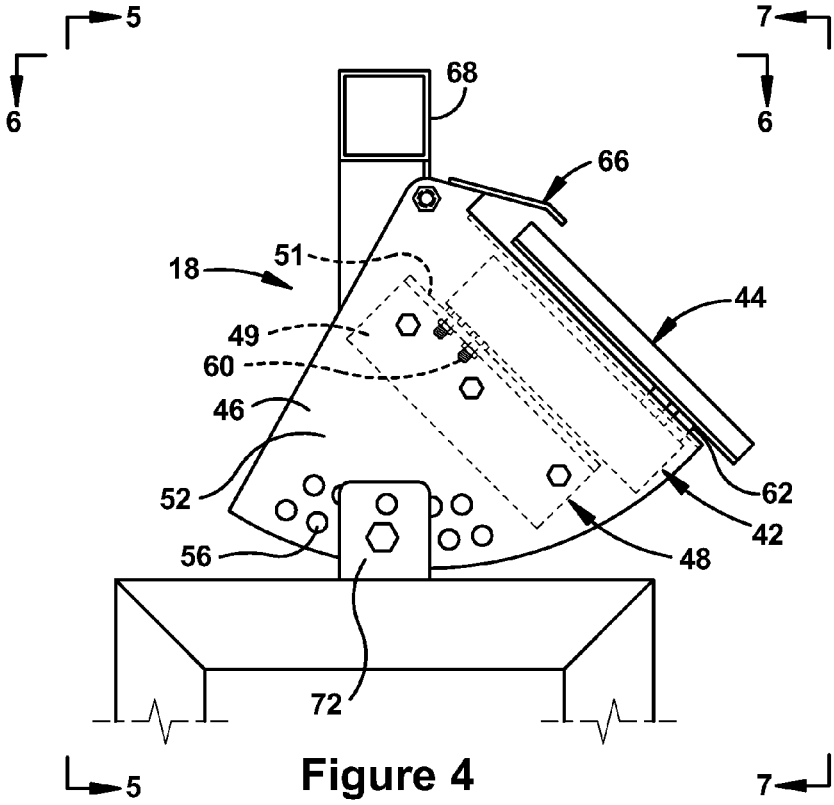
FIG. 4 is an enlarged portion of FIG. 3 showing a force detecting device.
Figure 5:
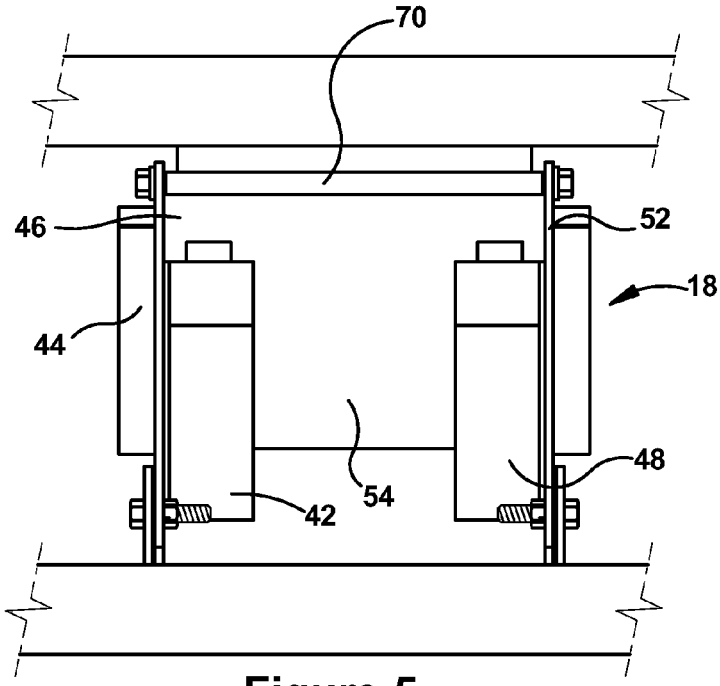
FIG. 5 is a view taken along the plane indicated by lines 5-5 in FIG. 4.
Figure 6:
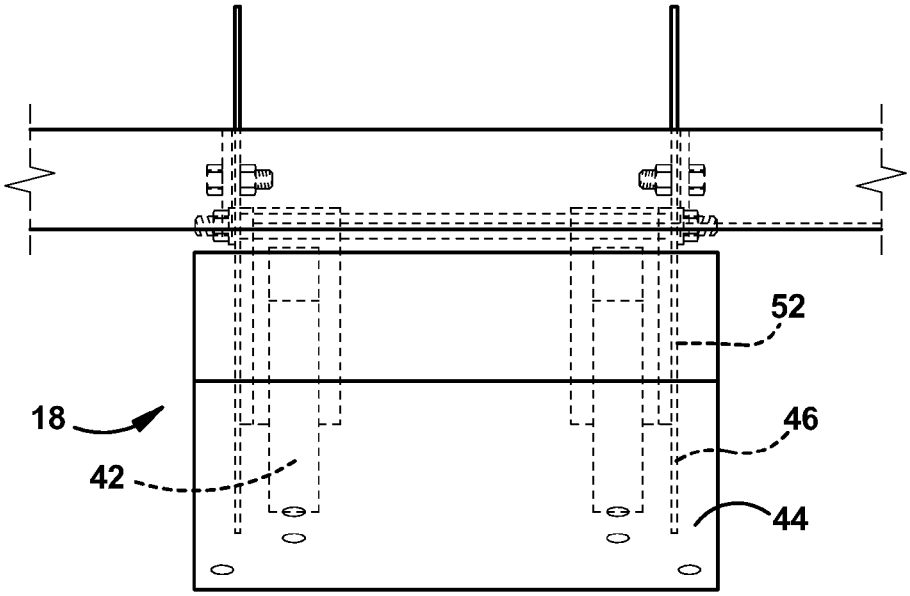
FIG. 6 is a view taken along the plane indicated by lines 6-6 in FIG. 4.
Figure 7:
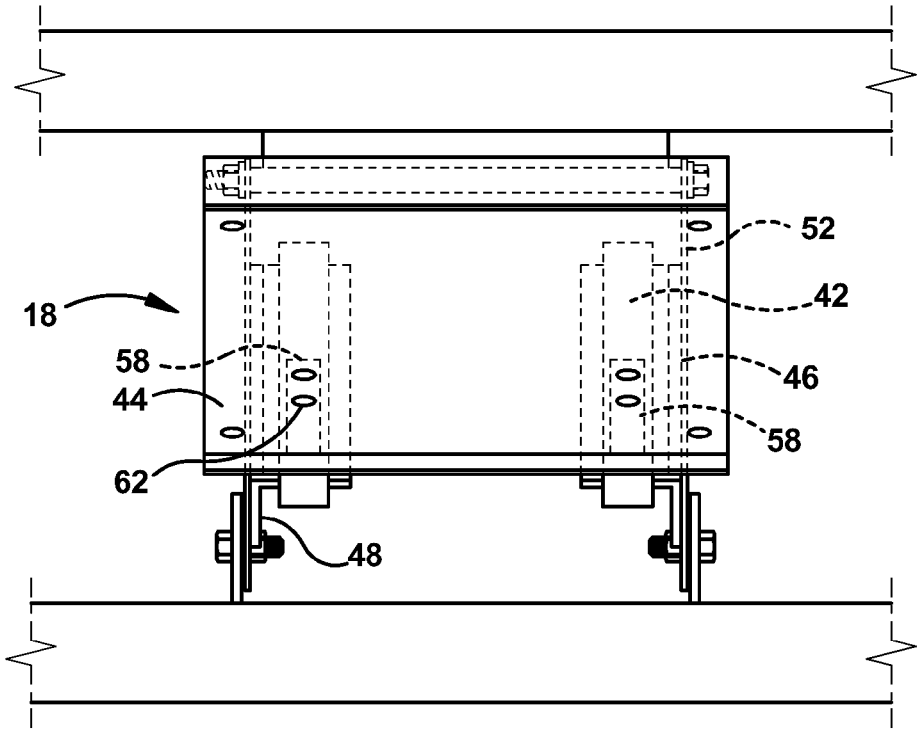
FIG. 7 is a view taken along the plane indicated by lines 7-7 in FIG. 4.
Figure 8:
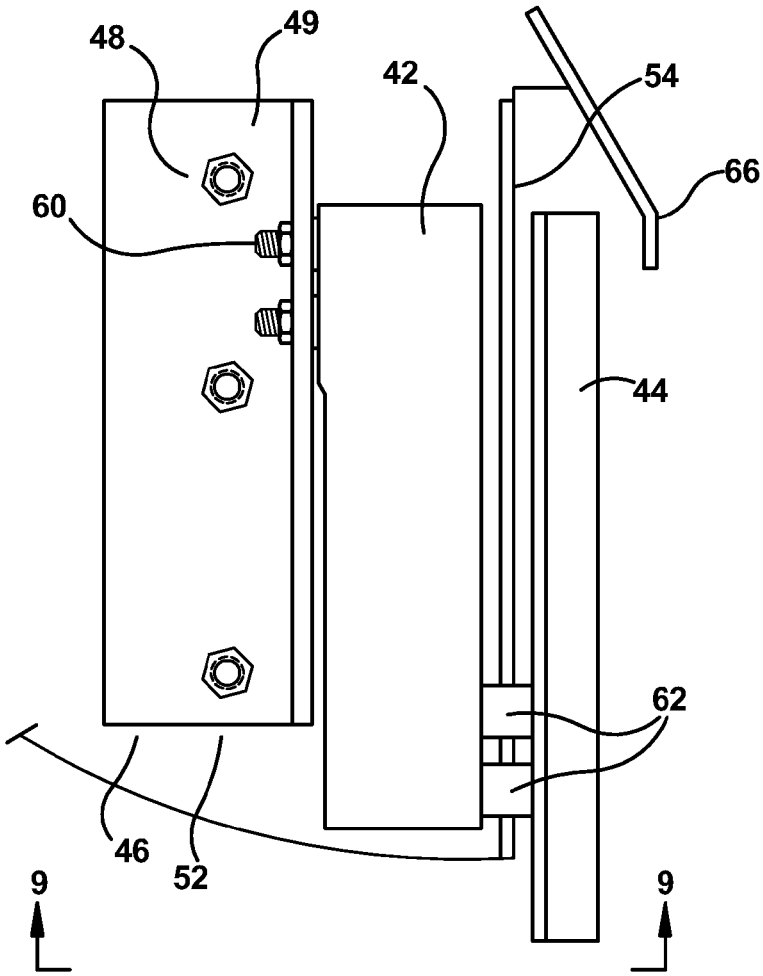
FIG. 8 is an enlarged portion of FIG. 4 showing components of one type of force detecting device.
Figure 9:
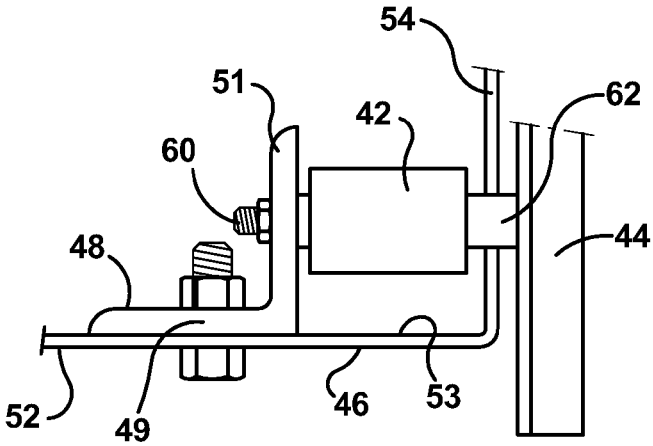
FIG. 9 is a view taken along the plane indicated by lines 9-9 in FIG. 8.
Figure 10:
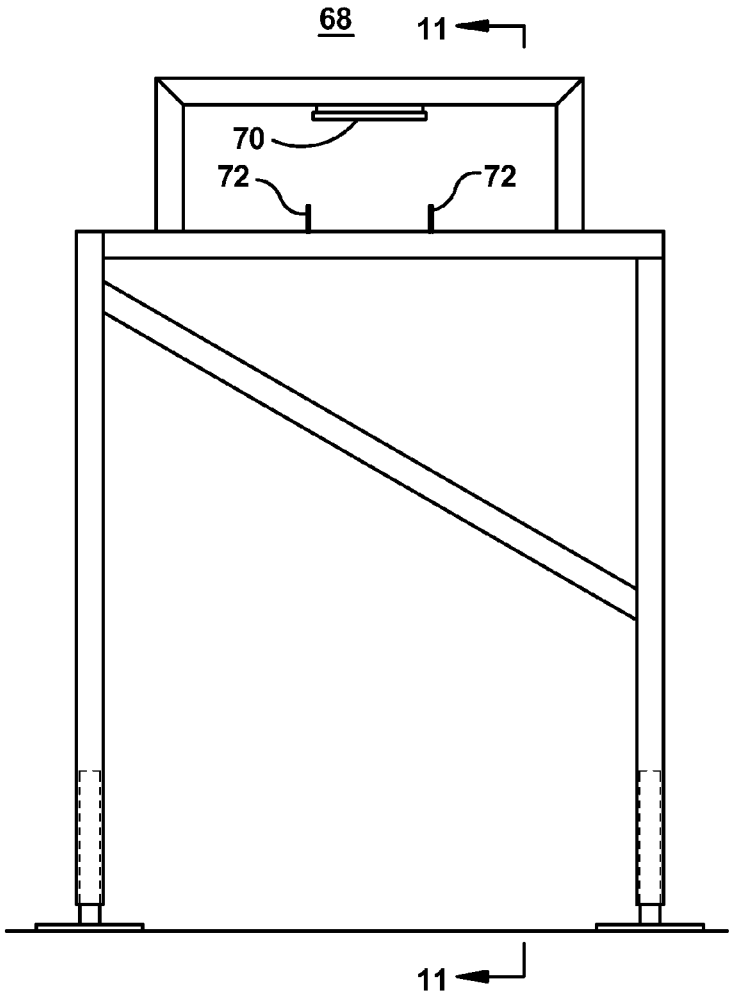
FIG. 10 is an elevation view of a force detecting device support frame.
Figure 11:
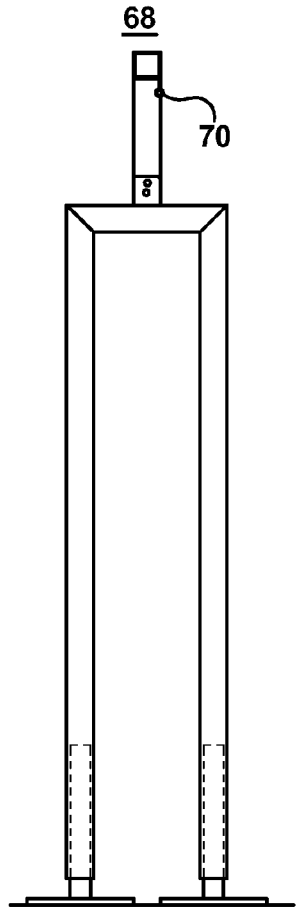
FIG. 11 is a view taken along the plane indicated by lines 11-11 in FIG. 10.

Referring to FIGS. 4-9, the illustrated force detection device 18 includes a pair of load cells 42, a product portion engagement platform 44, a frame 46, and a pair of support angles 48. The frame 46 includes a pair of side walls 52 that extend from a center wall 54. Referring to FIG. 4, a plurality of aligned holes 56 are included in the side walls. The holes 56 allow adjustment of the angle of the force detection device platform 44 with respect to the conveyor 16. The center wall 54 includes a pair of clearance slots 58 (FIG. 7) that allow attachment of the platform 44 to the load cells. The support angles 48 each include a first flange 49 that is attached to an inner surface 53 (FIG. 9) of a side walls 52 and a second flange 51. Each load cell 42 is connected to a support angle second flange 51 behind the center wall 54 by a pair of connections 60. An example of one type of load cell that could be used is HBM Model #PW15. In the illustrated embodiment, the pair of connections 60 space each load cell away from it respective support angle. For example, each connection 60 may include a 1/16" spacer between the load cell and the support angle. The platform 44 is connected to the pair of load cells 42 by a pair of connections 62. The pair of connections 62 extend through the clearance slots 58 and position the platform 44 in front of the center wall 54. For example, each connection 62 may include a ½" spacer that extends though a clearance slot 58.

Referring to FIGS. 3, 4, 10 and 11, a deflector plate 66 is attached to the side walls 52. The deflector plate 66 extends over the platform 44. Small pieces of product and other debris that become disposed in spaces between the platform 44 and the center wall 54, between the center wall 54 and the load cells 42, and/or between the load cells and the support angles 48 could adversely effect the forces detected by the force detecting device. The deflector plate 66 inhibits small pieces of product or other debris from entering these spaces.

In the illustrated embodiment, the force detecting device 18 is positioned with respect to the conveyor 16 and guide 40 by a framework 68. The framework includes an upper connection sleeve 70 and a pair of lower connection flanges 72. A fastener extends through the side walls 52 and the sleeve 70 to pivotally connect the force detecting device 18 to the framework. A pair of fasteners extend through the flanges 72 and a pair of aligned holes 56 in the side walls 52. The selection of the pair of aligned holes 56 determines the angle of the force detecting device 18 with respect to the conveyor 16 and guide 40. In the exemplary embodiment, the angle of the platform 44 is set such that the product portions that impact the platform 44 are directed to the directing structure 22.

Figure 12:
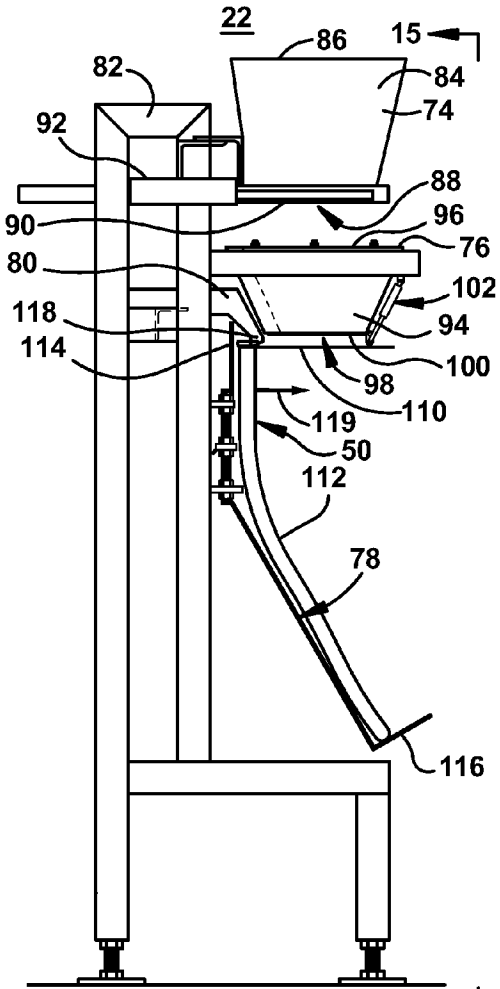
FIG. 12 is an elevation view of a directing structure for directing product portions into containers.
Figure 15:
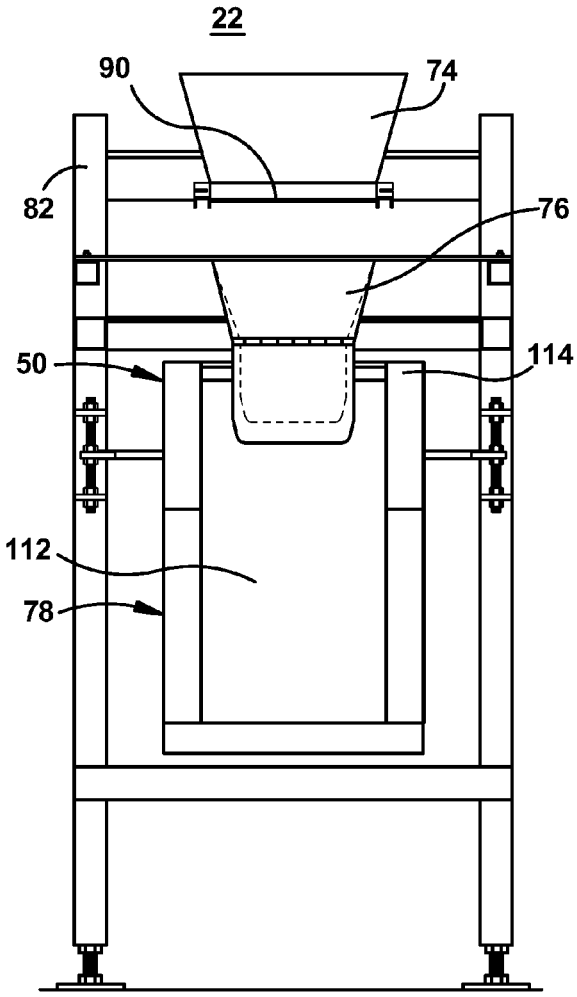
FIG. 15 is a view taken along the plane indicated by lines 15-15 in FIG. 12.
Figure 16:
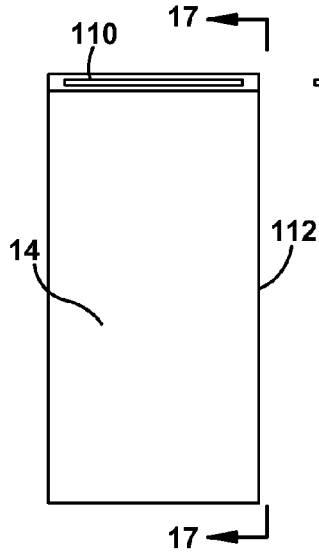
FIG. 16 is a view of a wicket of bags.
Figure 17:
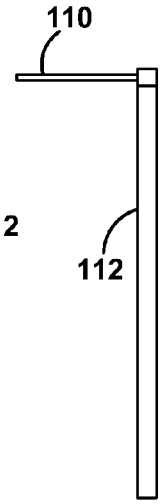
FIG. 17 is a view taken along the plane indicated by lines 17-17 in FIG. 16.

Referring to FIGS. 3 and 12-15, the illustrated directing structure 22 directs the product portions 12 from the platform 44 to containers 14. The directing structure could take a wide variety of forms without departing from the spirit and scope of the present invention. An example of one acceptable directing structure is illustrated. The illustrated directing structure 22 includes a buffer hopper 74, a bag hopper 76, a container support 78, a container opening device 80, and a framework 82. The buffer hopper 74 is positioned to accept product portions 12 from the force detecting device 18. Referring to FIG. 12, the buffer hopper 74 includes a receptacle 84 with an entrance opening 86 and an exit 88. The exit 88 includes a door 90 that is selectively openable (FIG. 14) and closable (FIG. 12) by an actuator 92. The actuator 92 is controlled by the controller 34 to selectively open or close the exit of the buffer hopper 74. In the illustrated embodiment, buffer hopper 74 is supported by the framework 86.

The bag hopper 76 is positioned beneath the buffer hopper 74 to accept product portions from the buffer hopper. Referring to FIGS. 12-15, the bag hopper 76 includes a receptacle 94 with an entrance opening 96 and an exit 98. The exit 98 includes a door 100 that is selectively openable (FIG. 14) and closable (FIG. 12) by an actuator 102. The actuator 102 is controlled by the controller 34 to selectively open or close the exit of the bag hopper 76. In the illustrated embodiment, bag hopper 76 is supported by the framework 86.

Referring to FIGS. 12-15, the illustrated container support 78 supports a wicket 110 of bags 112. The support 78 includes a wicket mount 114 and a lower support 116. The wicket mount 114 supports a wire wicket 110 loaded with bags 112. The lower support 116 supports bottoms of the bags 112 that are suspended by the wicket.

Figure 14:
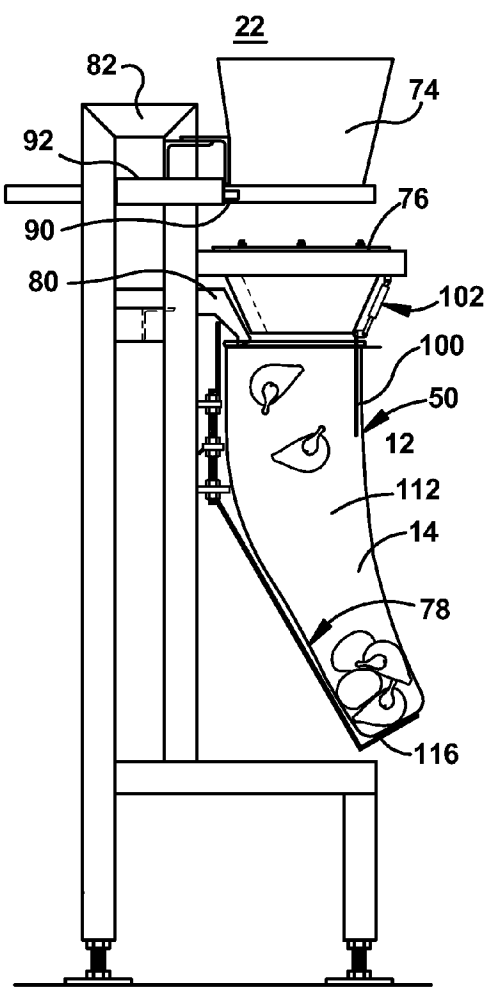
FIG. 14 is an elevation view of a directing structure for directing product portions into containers.
Figure 13:
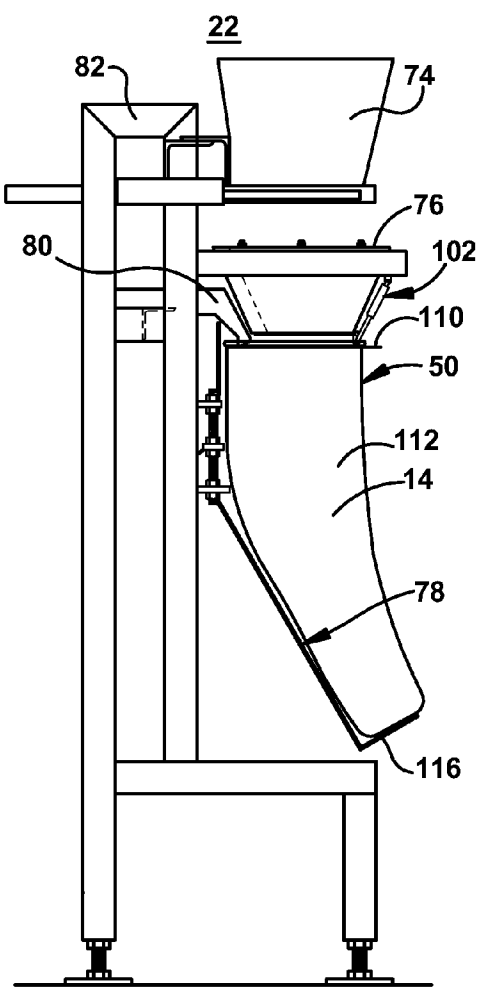
FIG. 13 is an elevation view of a directing structure for directing product portions into containers.

The illustrated container opening device 80 is a blower with a nozzle 118. Referring to FIG.12, the nozzle 118 is positioned to blow air into a bag 112 pulled outward as indicated by arrow 119. Referring to FIG. 13, air blown into the bag 112 opens the bag 112 beneath the bag hopper 76. Referring to FIG. 14, the controller 34 opens the door 100, which holds the bag open, allowing product portions 12 to fall from the bag hopper into the bag 112. The bag 112 is maintained in an open condition by the door 100 until the desired count of product portions 12 is in the bag. The door 100 is closed and the bag is removed from the wickets when the desired count is reached. The next bag is then opened by the container opening device 80.

When the apparatus is first started, air is supplied to the to the nozzle 118 to open a bag 112. The controller 34 opens the buffer hopper 74 and the bag hopper 76. The bag hopper door holds the bag open. The controller 34 controls the motor 26 to begin movement of the flighted belt 24. An operator at the loading station 30 begins placing discrete product portions between pairs of conveyor vanes 32. The conveyor 16 moves the product portions to the guide 40. The product portions 12 slide down the guide into engagement with the force detecting device 18. The force detecting device measures the force applied by each portion and provides a corresponding signal to the controller each time an impact is sensed. The controller adds one to the product count each time a force in the product identifying range is measured. In one embodiment, the buffer hopper 74 and the bag hopper 76 remain open and product portions enter the first container until the product count reaches the preset count. In this embodiment, the product portions fall directly into the bag or container 112. In the exemplary embodiment, the controller closes the buffer hopper and the bag hopper 76 a predetermined time after the last product portion in the preset count impacts the force detecting device. This predetermined time delay allows the last product portion in the count to fall into the bag. Once the last product portion in the count falls into the opened bag, the controller closes the bag hopper 76 and the buffer hopper 74. The conveyor 16 continues to run and product portions accumulate in the buffer hopper 74 as an operator removes the filled bag. The apparatus 10 continues to run and provide product portions 12 into the buffer hopper 74 until a predetermined buffer full count is reached. The buffer count typically corresponds to the count of the next container to be filled. If a ready signal has not been received from an operator interface button that indicates the filled container has been removed, the conveyor is stopped until the signal is received by the controller. If the full container is removed and a ready signal is received by the controller before a buffer full count is reached, the buffer will open and product will continue to be fed to the force detecting device. Once the filled bag is removed, air is again supplied to the to the nozzle 118 to open a second bag 112. The controller 34 opens the buffer hopper 74 and the bag hopper 76 to drop the product portions in the buffer hopper into the second bag. In one embodiment, the speed of the conveyor is slowed during a transition period when product portions begin to be directed to the second container. Product portions are supplied to the second bag until the count for the second bag reached. This process is repeated for each container. In one embodiment, an additional staging or buffer hopper is included to reduce the number of times the conveyor is stopped.

In the illustrated embodiment, the flighted conveyor belt 24 is manually loaded with one product portion 12 per pocket as the conveyor moves. The pockets 33 may be configured such that the pockets are wider and longer than the average product portion to provide a large target for easier loading. One downside of the larger pockets is that operators can accidentally load one pocket with two product portions. A miscount occurs when an operator places two or more product portions in a single conveyor space.

In the exemplary embodiment, the controller 34 is programmed to identify product portion miscounts. A miscount occurs when an operator places two or more product portions in a single conveyor space. If the impact of more than one product portion with the force detecting device is given a single count, the count for the container will be off (i.e. the processor will be "giving away" product portions). In the exemplary embodiment, the controller includes a timer 120 for measuring the time between impacts with the force detecting device. In the illustrated embodiment, the timer 120 is included in the controller 34.

The product portions of a double loaded pocket may be disposed in the conveyor pockets in a variety of different configurations. For example, the second product portion may be directly on top of the first product portion. The second product portion may be on the right or left side of the first product portion. The second product portion may be in front of or behind the first product portion.

In one embodiment, the controller is programmed to identify miscounts using the force applied to the force detecting device 18 and the time between impacts with the force detecting device. A force applied to the force detecting device that is greater than a predefined maximum force for a given type of product portion is indicative of a miscount due to double loading of a conveyor pocket. The controller will identify a product portion miscount when a force greater than a maximum product identifying force value is measured. For example, the controller may be programmed to identify a miscount when the measured force is approximately the force that would be applied if two product portions are stuck together.

A shorter than normal time between engagements of the force detecting element is also indicative of double loading of a conveyor pocket. The controller is programmed to identify a product portion miscount when the time between engagements of product portions with the force detection device is less than a predefined minimum time between engagements. For example, the controller may be programmed to identify a miscount when the time between engagements of product portions is between ⅓ to ½ of the standard time between engagements.

In the exemplary embodiment, the operator may select how the apparatus deals with miscounts via the user input device 36. One option available to the operator is to allow the controller to automatically correct the count based on input from the force detecting device when a product portion miscount is identified. For example, when the controller senses that two product portions were loaded into a single conveyor pocket the controller will automatically add two to the product count (rather than one) to correct the count.

A second option available to the operator is to allow the controller to finish filling the container when a miscount is detected, but provide an indication or flag that a miscount has been detected. The flagged container can then be inspected or weighed to determine whether a miscount actually occurred.

A third option available to the operator is to allow the controller to stop the flow of product portions into the first container when a miscount is detected, reset the product portion count, and direct product portions into another container. Under this option, the controller may also provide some indication or flag that the count for the first container is incorrect. The product portions in the first container may then be returned to the loading station 30 for loading into a subsequent container. This option eliminates time consuming recounts that can occur when a miscount is detected. This option is especially useful when the predefined count for a given container is high and the miscount is detected early on in the container filling process.

With each of these options, the controller keeps track of the double counts or the miscounts and allows the operator to access a report. In the exemplary embodiment, the user interface allows these options for responding to miscounts to be combined. For example, the user may request that the controller automatically correct the count and provide an indication that a miscount has occurred. The user may also set the controller up to take different actions depending on where in the count the miscount occurs. For example, if the miscount occurs early in the count (for example, product portion 10 of 100) filling of the container is stopped and filling of the next container begins. If the miscount occurs late in the count (for example, product portion 90 of 100) filling of the container is finished and the container is flagged.

In one embodiment, the user input device allows the operator to place the controller in a calibration mode and set-up mode. The calibration mode is available to set up the force detection minimums and maximums that represent the typical product portions impacting the force detection device 18. The calibration mode also allows the input of the typical time period between each impact. That is, how long it should take force detecting device impacts if each pocket is loaded with a product portion.

In set-up mode, using a set-up menu of the user input device, the user may enter the desired count per container. The set-up mode also allows the user to enter the desired number of containers to be filled for a particular product order.

Alternate Exemplary Embodiment of Apparatus 10

Figure 18:
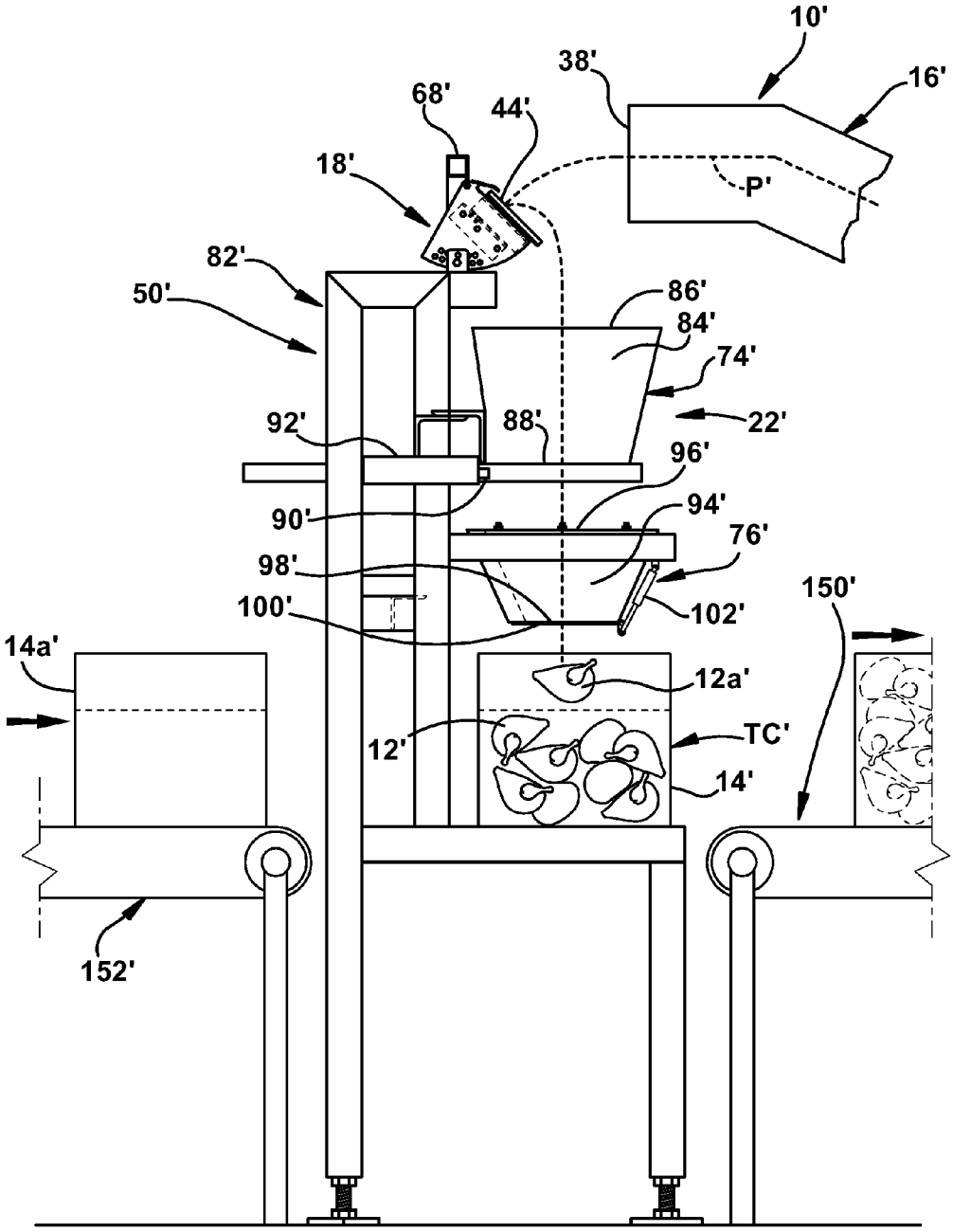
FIG. 18 is an elevation view of selected components of a second exemplary embodiment of an apparatus for counting and filling containers with product portions of the present invention.
Figure 19:
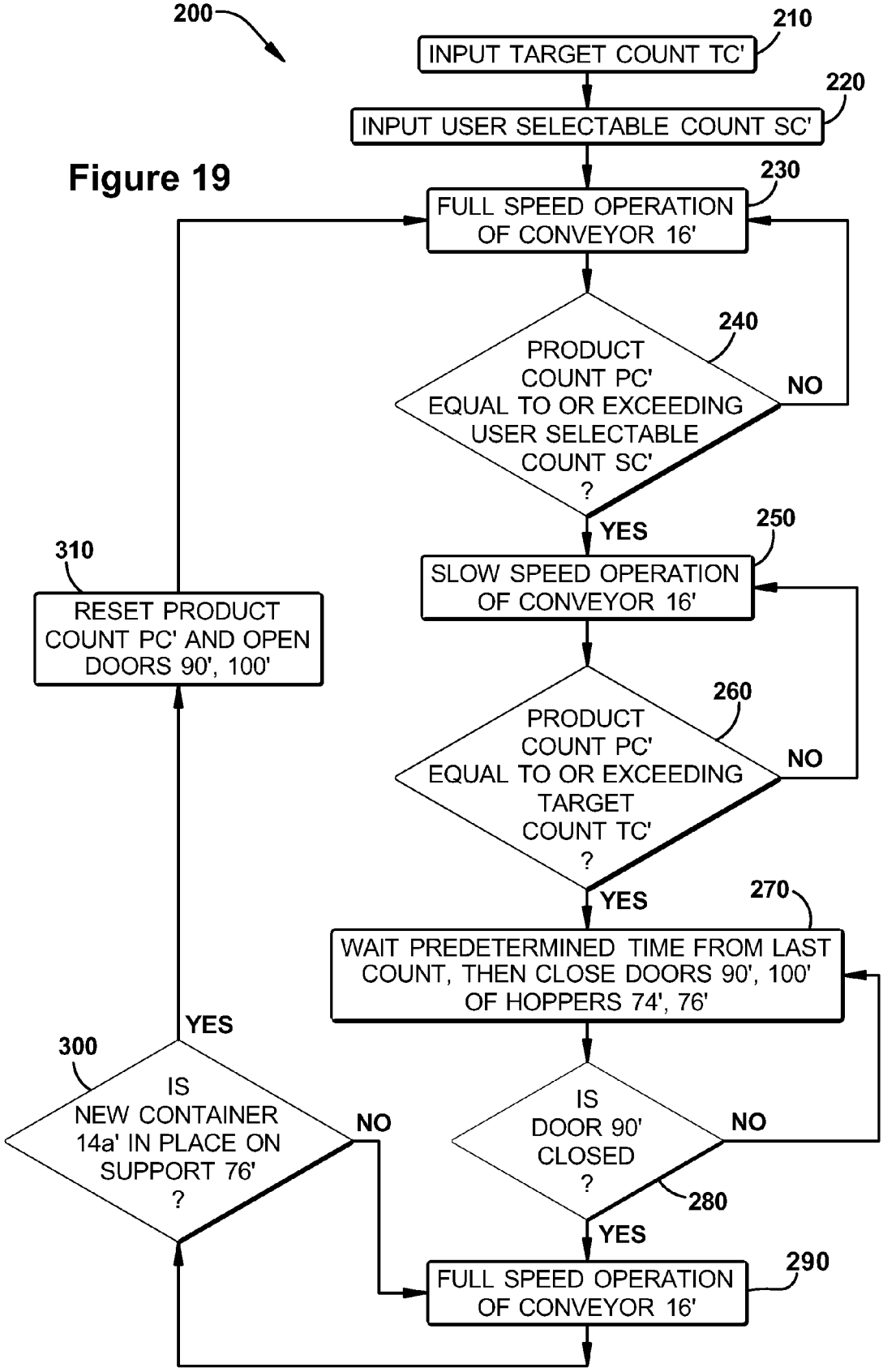
FIG. 19 is a schematic flow diagram of an exemplary method of operation of counting and filling containers with product portions in accordance with the present invention.

An alternate exemplary embodiment of the apparatus of the present invention is schematically shown at 10' in FIG. 18. Additionally, two alternate exemplary processes or methods of operation of counting and filling containers and transitioning from filling a full first container 14' to a second empty container **14*a*' are schematically shown in flow diagram form at 200 and 400, respectively, in FIGS. 19 and 20. As discussed below, the method of operation 200 shown in FIG. 19 is an aggressive method of operation of the apparatus 10 (or 10'), while the method of operation 400 shown in FIG. 20** is a more conservative method of operation.

The apparatus 10', like the apparatus 10 of the first embodiment, is advantageously used for counting product portions 12' and filling containers 14' to have predetermined desired product portion target count TC'. For brevity, only the components of the apparatus 10' that are different than the apparatus 10 and method described above will be discussed, it being understood that the remaining components of the apparatus 10' and method of operation of the apparatus 10' is as described above with respect to the apparatus 10'. For brevity, only selected components of the apparatus 10' are shown in FIG. 18, it being understood that the remaining components and functioning of the apparatus 10' are present substantially as shown and described with respect to the apparatus 10 above.

It should be noted that the apparatus 10' of the present invention is equally applicable to being used with containers 14' other than containers comprising the wicket 110 and bags 112, as described above. For example, the apparatus 10' may be used with a box or tub. This is shown in FIG. 18 wherein the first container or box 14' positioned at the packaging station 50' of the apparatus 10' has the desired target count TC' is filled and ready for removal from the apparatus 10'. The filled box 14' is positioned on a container support 78' of the station 50' and is ready to be transferred to an outbound table or conveyor 150'. A second empty container or box **14*a*' is positioned on an inbound table or conveyor 152' ready to be placed on a container support 78' of the apparatus 10'** for filling.

As can be seen in FIG. 18, in the apparatus 10', the container support 78' has been modified to delete the container opening device 80, wicket of bags 112, nozzle 118, etc., as compared to the apparatus 10. However, it should be recognized that the apparatus 10' may easily be modified to include the container opening device 80, just as the apparatus 10 may easily be modified to delete the container opening device 80. The apparatus 10, 10' may easily be modified depending on the specific needs of the product portions to be counted and the customer's choice of containers.

Figure 18A:
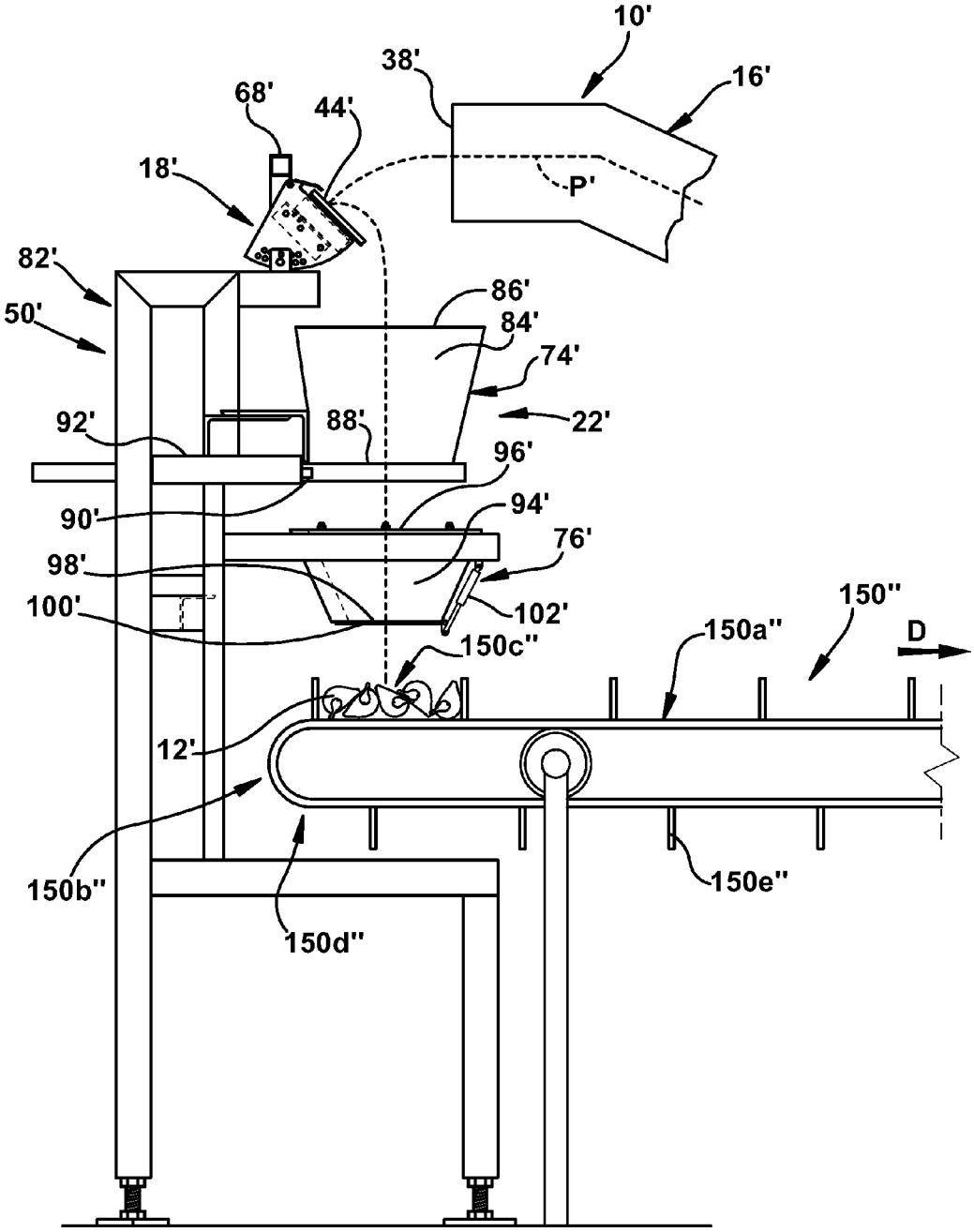
FIG. 18A is an elevation view of a second exemplary embodiment of an apparatus for counting and filling containers as shown in FIG. 18 utilizing pockets of a flighted exit conveyor as containers in lieu of boxes, tubs or bags.

As shown in FIG. 18, the container support 78' may be a simple table for supporting the box 14 during filling or may include rollers to allow easy sliding transfer of the filled box 14' from support 78' to an adjacent outbound conveyor 150'. Alternately, the support 78', if desired, may be integrated into the outbound or exit conveyor 150' as shown in FIG. 18A.

Turning to FIG. 18, in the apparatus 10', the guide 40 of the first apparatus 10' has been removed and the product portions 12' move along a path of travel P' and are ejected directly from the end 38' of the conveyor 16' (as shown in the dashed path of travel P') to contact or impact the product portion engagement platform 44' of the force detecting device 18'. As described above, the force detecting device 18' is positioned with respect to the conveyor 16' by the framework 68'. Also, as described previously, the directing structure 22' includes the buffer hopper 74', the bag hopper 76' supported on the framework 82'.

The buffer hopper 74' includes the receptacle 84', the entrance opening 86', the exit opening 88', the door 90', and the door actuator 92' operating under the control of the controller 34 (not shown in FIG. 18) to open and close the door 90', as described above. Similarly, the bag hopper 76' includes the receptacle 94', the entrance opening 96', the exit opening 98', the door 100', and the door actuator 102' operating under the control of the controller 34 to open and close the door 100', as described above.

Alternately, in automated applications, the "containers" may be configured as adjacent pockets or openings defined by a flighted belt of an exit conveyor 150". This is shown schematically in FIG. 18A. Instead of a flat table container support 78' as shown in FIG. 18, the container support 78" comprises the exit conveyor 150" having a flighted conveyor belt 150*a*". As seen in FIG. 18A, an end portion 150*b*" of the exit conveyor 150" is positioned under the bag hopper 76'. The pockets of the exit conveyor, for example pockets 150*c*", 150*d*", would be similar to the pockets 33 of the flighted conveyor 16 in the first embodiment.

Each pocket defined by the vanes or paddles 150*e*" of the flighted belt 150*a*" would define a container and the exit conveyor flighted belt would be moved incrementally to align a first container or pocket 150*c*" under the bag hopper 76' to receive product portions 12'. Once the target count TC' is achieved for the first container or pocket 150*c*", the flighted belt 150*a*" would be incremented or advanced in a direction D a distance equivalent to a distance between vanes 150*e*" of the conveyor belt 150*a*" to align an adjacent or second pocket or container 150*d*" under the bag hopper 76'.

Alternate Exemplary Methods of Operation

In discussing exemplary embodiments of the process or method of operation of the apparatus 10 with respect to filling containers and counting product portions, it was previously mentioned that in one embodiment, the controller 34 would slow the speed of the conveyor 16 during a transition period when product portions 12 began to be directed to a second container. When a first bag 112 was filled, it was removed from the lower support 116 by the operator, and a new bag 112 was opened by the container opening device 80. Thus, as mentioned above, the controller 34 optionally slowed a speed of the conveyor 16 during a transition period when the target count is reached for a first container 112 and product portions 12 begin to be directed to the second container. At least one of the reasons for this reducing the conveyor speed was to avoid overfilling of the buffer hopper 74 while the operator 31 removed a filled bag from the lower support 116.

During high volume counting and filling operations, where a high speed of the conveyor 16' is required, there may be a need for slowing the speed of the conveyor 16' during a pre-transition period instead of or in addition to slowing the speed of the conveyor 16' during the transition period, as described in the previous operating embodiments. Assume that the target count TC' has been input via the user input device 36 (not shown in FIG. 18-*see* FIG. 3 for user input device 36 and description above) for container 14', also assume that the last product portion needed to achieve the target count TC' for container 14' is product portion 12*a'*.

One problem that may occur, particularly during high volume operations, is that it may be difficult to determine with accuracy, the time elapsed between the last product portion 12*a'* impacting the product portion engagement platform 44' of the force detecting device 18' to the point at which the product portion 12*a'* completely clears the door 100' of the bag hopper 76'. Thus, if product portions 12' are being ejected from the conveyor end 38' in rapid fire succession, it may be difficult for the controller 34' to accurately assign a predetermined time delay for the time between the last product portion 12*a'* impacting the product portion engagement platform 44' and closing the doors 90', 100' of the buffer and bag hoppers 74', 76'.

One solution to this problem is to allow the operator 31 though the user input device 36 of the controller 34 to input a user selectable transition count SC' very close to the target count TC' at which time the controller 34 slows the speed of the conveyor 16'. Generally, the user selectable transition count SC' would be required to be within a predetermined range of the target count TC' (by way of example only, say five percent of the target count TC') so as not to unnecessarily slow the conveyor 16' too soon before transition occurs. For example, if the target count TC' were 100 portions in a container 14', then the transition count SC' may be 95.

Upon the transition count SC' being reached, the speed of the conveyor 16 is reduced until a selected one of two events occurs: 1) an indication that door 90' of the buffer hopper 74 is closed; or 2) an indication from the operator 31 via the user input provides a signal via the user input device 36 that the second container 14*a'* is in place on the container support 78' and ready for filling. When the selected triggering event occurs, the controller 34 resumes full speed operation of the conveyor 16'.

Essentially, the first method, namely, resuming full speed of conveyor 16' upon an indication that the buffer hopper door 90' is closed, is an aggressive method of operation, while the second option, namely, resuming full speed of conveyor 16' upon an indication that the second container 14*a'* is in place, is a more conservative method of operation. A comparison of the two methods can best seen in FIGS. 19 and 20.

In the aggressive method of operation of the apparatus 10' shown generally at 200 in FIG. 19, using the user input device 36, the operator, at step 210, inputs the target TC and at step 220, inputs the transition count SC. At step 230, the controller 34 operates the conveyor 16' at full speed. As product portions 12' strike the product portion engagement platform 44', a product count PC' of the product portions 12' is incremented by the controller 34, as described previously.

At step 240, if the product portion product count PC' is equal to or exceeds the transition count SC', then at step 250, the controller 34 reduces the speed of the conveyor 34' to a predetermined slower speed. Product portions 12' continue to strike the product portion engagement platform 44', albeit at a slower rate, and the product count PC' is incremented. At step 260, if the product portion product count PC' is equal to or exceeds the target count TC', then at step 270, the controller 34 waits a predetermined time from the last count (that is, the last strike of the product portion engagement platform 44' by a product portion 12'), then closes the doors 90', 100' of the buffer and bag hoppers 74', 76'.

At step 280, the controller 34 determines if the buffer hopper door 90' is closed. If not, the process 200 loops back to step 270 until such time as the buffer hopper door 90' is closed. When the buffer hopper door 90' is determined to be closed, then at step 290, the controller 24 resumes full speed operation of the conveyor 16'. Assuming for a moment that the operator 31 has not yet removed the filled container 14' and positioned the new container 14*a*' on the container support 76', then product portions 12' will be deposited into the buffer hopper 74' at a rapid pace because the conveyor 16' is being operated at high speed.

At step 300, while the conveyor 16' is still operating at full speed, the controller waits for a signal from the operator 31 indicating that the new container is in place on the container support 76', when such indication is received from the operator, then, at step 310, the controller 34 resets the product count PC' and opens the buffer hopper and bag hopper doors 90', 100', and the process reverts to step 230 where full speed operation of the conveyor 16' continues.

Note that during the transition period where the operator is removing the filled container 14' and placing the new container 14*a*' into position on the container support 76', the conveyor 16' is operating at full speed. Assuming the operator 31 can position the new container 14*a*' on the support 76' in a timely manner, this method of operation increases the overall operational efficiency of the apparatus 10', compared to the conservative method 400, because the conveyor 16' is operating at full speed for a greater percentage of time compared to the second method 400. The risk, of course, is that if the operator 31 takes too long of time to remove the full container 14' and position the new container 14*a*' on the support 76', the controller 34 will have to stop the conveyor 16' completely to avoid a situation either the buffer hopper 74' being filled to an overcapacity condition or the count of product portions 12' in the buffer conveyor 74' exceed the target count TC' for the next container 14*a'*.

Figure 20:
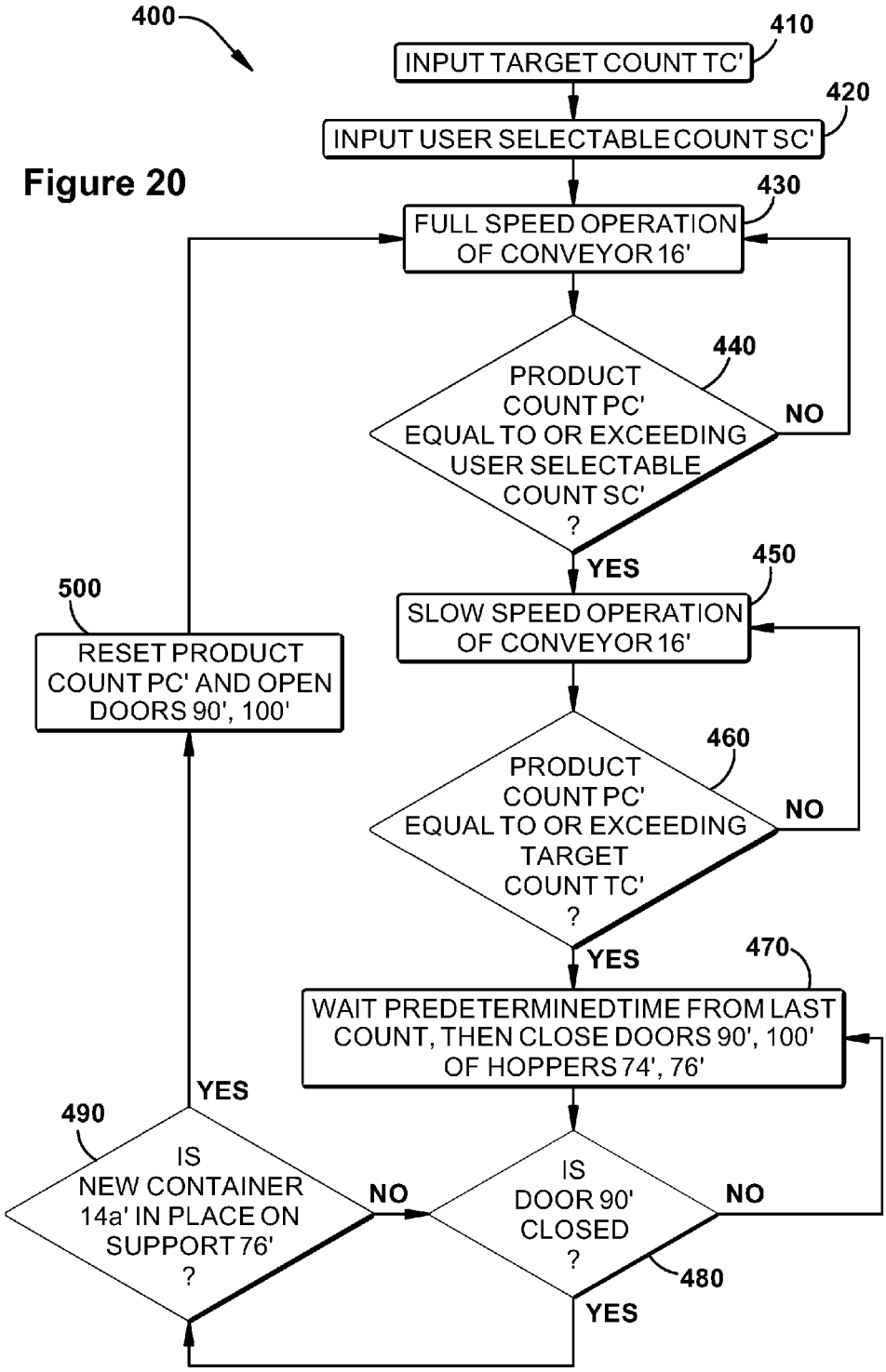
FIG. 20 is a schematic flow diagram of another exemplary method of operation of counting and filling containers with product portions in accordance with the present invention.

The more conservation method of operation is shown at 400 in FIG. 20. At step 410, using the user input device 36, the operator inputs the target TC and at step 420, inputs the transition count SC'. At step 430, the controller 34 operates the conveyor 16' at full speed. As product portions 12' strike the product portion engagement platform 44', a product count PC' of the product portions 12' is incremented by the controller 34, as described previously.

At step 440, if the product portion product count PC' is equal to or exceeds the transition count SC', then at step 450, the controller 34 reduces the speed of the conveyor 34' to a predetermined slower speed. Product portions 12' continue to strike the product portion engagement platform 44', albeit at a slower rate, and the product count PC' is incremented. At step 460, if the product portion product count PC' is equal to or exceeds the target count TC', then at step 470, the controller 34 waits a predetermined time from the last count (that is, the last strike of the product portion engagement platform 44' by a product portion 12'), then closes the doors 90', 100' of the buffer and bag hoppers 74', 76'.

At step 480, the controller 34 determines if the buffer hopper door 90' is closed. If not, the process 400 loops back to step 470 until such time as the buffer hopper door 90' is closed. When the buffer hopper door 90' is determined to be closed, then at step 490, the controller 24 waits for a signal from the operator 31 that the new container 14*a*' is in place on the container support 76' and is ready for filling. Until the operator 31 provides the signal that the new container 14*a*' is in place and ready for filling, slow speed operation of the conveyor 16' continues.

At step 490, when the controller 34 receives a signal from the operator 31 indicating that the new container is in place on the container support 76', then, at step 500, the controller 34 resets the product count PC' and opens the buffer hopper and bag hopper doors 90', 100', and the process reverts to step 430 where full speed operation of the conveyor 16' recommences.

Note that during the transition period where the operator is removing the filled container 14' and placing the new container 14*a*' into position on the container support 76', the conveyor 16' is operating at reduced speed. Essentially, the conveyor 16' is operating at a reduced speed during an enlarged transition period that includes the pre-transition period and the transition period (as described earlier with respect to the apparatus 10), that is, during the entire period commencing from when the product count PC' equals or exceeds the transition count SC' all the way through the time that the operator or user 31 provides an indication that the new container 14*a*' is in position on the container support 76' and is ready for filling. While the method of operation 400 potentially decreases the overall operational efficiency of the apparatus 10' compared to method of operation 200, it does provide for greater control over the process for an operator 31 and provides greater leeway for an inexperienced operator, both of which may be viewed as positive benefits by management that outweigh any potential decrease in overall operating efficiency.

Set-Up and Calibration Modes

Via the user input device 26, the controller 34 can be placed in a set-up mode, a calibration mode, or an operating mode by the operator 31. In set-up mode, using a set-up menu of the user input device 26, the operator 31 may select the target count TC', the transition count SC' (if used), and the number of containers to be filled for a particular product order and, if permitted by management, also allows the operator 31 to select between the methods of operation 200, 400 discussed above. Alternately, the controller 34 may be programmed to only allow the method of operation 200, 400 to be changed by management personnel who have an administrator or system level password/authorization.

When the controller 34 is placed in calibration mode by the user input device 26, the product portion engagement platform 44, 44' of the force detecting device 18, 18' is subject to a predetermined force that simulates the force of an average product portion 12, 12' for a particular customer on the platform 44, 44' with when the average portion would be ejected from the conveyor end 38. For example, if a particular customer order called for 12-14 oz. chicken breasts, a 13 oz. chicken breast could be placed on the conveyor 16, 16' and moved along the path of travel P, P' to impact the platform 44, 44'. force Upon the 13 oz. chicken breast striking the platform 44 , 44', the force detecting device 18, 18' would measure calibration impact force (say, 1.0 lb). Based on the desired product range (e.g., 12-14 oz) input to the controller via the user input device 36, the controller 36 could then add, for example, ±9% to the measured calibration impact force to determine the force detection maximum and minimum values. The use of +9% would be appropriate since 13 oz+(0.09×13 oz)=13+1.17=14.17 oz. (approximately 14 oz.) and 13 oz.−(0.09×13 oz)=11.83 oz (approximately 12 oz.). Using this example, the controller would calculate the force detection minimum and maximum values as follows: maximum value=1.0 lb+0.09=1.09 lb; minimum value=1.0 lb−0.09=0.91 lb.

When in the operating mode, the controller 34 takes the given set-up and/or calibration parameters and operates the apparatus 10, 10' in a production mode to fill containers.

While the invention has been described with a degree of particularity, it is the intent that the invention includes all modifications and alterations from the disclosed design falling within the spirit or scope of the appended claims.

We claim:

1. A method of delivering desired counts of product portions into containers, comprising:

a) moving discrete product portions on a conveyor along a path of travel to engage a force detecting device;

b) repeatedly measuring force applied to the force detecting device;

c) adding one to a product count each time a force in a product identifying range is measured;

d) directing the product portions into a first container until the product count reaches a target count;

e) directing the product portions into a second container after the product count reaches the desired container count; and f) slowing a speed of the conveyor from a first speed to a second speed, the second speed being slower than a first speed, when the product count reaches a transition count, the transition count being less than the target count.

2. The method of claim 1 wherein including the additional step of increasing the speed of the conveyor a predetermined time after a product portion completing the target count engages the force detecting device.

3. The method of claim 2 wherein the speed of the conveyor is increased to the first speed.

4. The method of claim 1 including the additional step of increasing the speed of the conveyor when product portions begin to be directed to the second container.

5. The method of claim 4 wherein the speed of the conveyor is increased to the first speed.

6. The method of claim 1 wherein the force detecting device includes a force measuring load cell coupled to a product portion engagement platform which is engaged by the product portions.

7. The method of claim 1 wherein the target count per container is selectable by an operator.

8. The method of claim 1 wherein the minimum and maximum forces that define the product identifying range are selectable by an operator.

9. The method of claim 1 wherein the desired number of containers to be filled for a particular product order is selectable by an operator.

10. The method of claim 1 further comprising resetting the product count once the target count is reached.

11. The method of claim 1 further comprising identifying a miscount when a force greater than a maximum force of the product identified range is measured.

12. The method of claim 1 further comprising adding two to the product count when a force greater than a maximum force of the identified range is measured.

13. The method of claim 1 further comprising measuring times between engagements of product portions with the force detecting device and identifying a miscount when a measured time is less than a predefined minimum time between engagements.

14. The method of claim 1 further comprising measuring times between engagements of product portions with the force detecting device and adding two to the product count when a measured time is less than a predefined minimum time between engagements.

15. The method of claim 1 further comprising detecting a miscount by monitoring force applied to the force detecting device, stopping a flow of product portions into the first container when a miscount is detected, resetting the product portion count, and directing product portions into the second container.

16. A method of delivering desired counts of product portions into containers, the steps of the method comprising:

a) moving discrete product portions on a conveyor along a path of travel into engagement with a force detecting device, the conveyor moving at a first speed;

b) repeatedly measuring force applied to the force detecting device as discrete product portions engage said device;

c) adding one to a product count each time a force in a product identifying force range is measured;

d) directing the product portions into a first container until the product count reaches a target count;

e) directing the product portions into a second container after the product count reaches the target count; and f) slowing the conveyor to a slower second speed during a transition period, the transition period commencing when the product count in the first container is within a predetermined range of the target count.

17. The method of delivering desired counts of product portions into containers of claim 16 wherein the transition period ends a predetermined time after a product portion completing the target count engages the force detecting device.

18. The method of delivering desired counts of product portions into containers of claim 16 wherein the transition period ends when product portions are directed into the second container.

19. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured; and d) a directing structure for directing the product portions into a first container until the product count reaches a target count and directing the product portions into a second container after the product count reaches the target count; and e) a controller for slowing a speed of the conveyor from a first speed to a second speed, the second speed being slower than a first speed, when the product count reaches a transition count, the transition count being less than the target count.

20. The apparatus of claim 19 further including a container support for supporting the first container in alignment with the directing structure during filling of the first container.

21. The apparatus of claim 20 wherein the first container is a box or tub.

22. The apparatus of claim 20 wherein the first container is a bag dispensed from a wicket of bags and further wherein the container support includes a container opening device for opening the bag such that its opening is aligned with the directing structure prior to filling the bag.

23. The apparatus of claim 20 wherein the first container is a pocket of a flighted conveyor belt of an exit conveyor aligned with the directing structure prior to filling the pocket and wherein the flighted conveyor belt is advanced one pocket upon the product count in the pocket reaching the target count.

24. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured; and d) a directing structure for directing the product portions into a first container until the product count reaches a target count and directing the product portions into a second container after the product count reaches the target count; and e) a controller for slowing a speed of the conveyor from a first speed to a second speed, the second speed being slower than a first speed, during a transition period when product portions begin to be directed to the second container.

25. The apparatus of claim 24 further including a container support for supporting the first container in alignment with the directing structure during filling of the first container.

26. The apparatus of claim 25 wherein the first container is a box or tub.

27. The apparatus of claim 25 wherein the first container is a bag dispensed from a wicket of bags and further wherein the container support includes a container opening device for opening the bag such that its opening is aligned with the directing structure prior to filling the bag.

28. The apparatus of claim 25 wherein the first container is a pocket of a flighted conveyor belt of an exit conveyor aligned with the directing structure prior to filling the pocket and wherein the flighted conveyor belt is advanced one pocket upon the product count in the pocket reaching the target count.

* * * * *